US006732413B1

(12) United States Patent
Morris

(10) Patent No.: US 6,732,413 B1
(45) Date of Patent: May 11, 2004

(54) METHOD OF PRODUCING STRETCHABLE FABRICS

(75) Inventor: Paul A. J. Morris, Leeds (GB)

(73) Assignee: Pro-Fit International Limited, Leeds (GB)

( * ) Notice: Subject to any disclaimer, the term of this patent is extended or adjusted under 35 U.S.C. 154(b) by 146 days.

(21) Appl. No.: 10/048,503

(22) PCT Filed: Aug. 4, 2000

(86) PCT No.: PCT/GB00/02955

§ 371 (c)(1),
(2), (4) Date: May 9, 2002

(87) PCT Pub. No.: WO01/11131

PCT Pub. Date: Feb. 15, 2001

(30) Foreign Application Priority Data

Aug. 6, 1999 (GB) ..... 9918486

(51) Int. Cl.[7] ..... D03D 7/00
(52) U.S. Cl. ..... 28/156; 28/155
(58) Field of Search ..... 28/134, 137, 138, 28/155, 156, 166, 165, 151, 157, 116, 122; 26/18.5, 18.6; 139/421; 264/280, 282, 283, 319, 324, 285

(56) References Cited

U.S. PATENT DOCUMENTS 2,021,975 A * 11/1935 Wrigley et al. ..... 26/18.6
2,319,809 A * 5/1943 Francis, Jr. ..... 26/155
2,573,773 A * 11/1951 Rowe ..... 28/155
3,001,262 A * 9/1961 Parker et al. ..... 28/155
3,438,842 A * 4/1969 Petterson et al. ..... 28/156
3,473,576 A * 10/1969 Amneus ..... 28/156
3,504,712 A * 4/1970 Dusenbury et al. ..... 139/421
3,538,563 A * 11/1970 Tsuruta et al. ..... 26/18.6
3,723,217 A * 3/1973 Bauer ..... 28/155
3,867,248 A * 2/1975 Bauer ..... 442/263
4,041,581 A * 8/1977 Diggle, Jr. ..... 26/18.6
4,051,215 A * 9/1977 Tsuruta et al. ..... 26/18.6
5,987,721 A * 11/1999 Morris ..... 28/155

* cited by examiner

*Primary Examiner*—A. Vanatta
(74) *Attorney, Agent, or Firm*—Howard & Howard

(57) ABSTRACT

A method of treating a woven fabric of thermoplastic synthetic fibres to produce a two-way stretchable fabric (20) which comprises providing a fabric (20) having stretch characteristics in the width direction, applying heat and pressure to the fabric (20) in such a manner that the yarn strands substantially across the width of the fabric (20) are forced closer together thus imparting stretch into the fabric (20) in the length direction. The fabric (20) material is a synthetic material which is thermoplastic and can be heat set, such as a polyester or polyamide textile material. Stretch in the width direction (normally the weft direction) may be produced conventionally, but owing to processing constraints, it is not normally as easy to produce as much stretch in the length (or warp) direction. By subjecting such a fabric (20) to compressive shrinkage, the stretch in the warp direction is increased. Moreover, owing to the thermoplastic nature of the yarns, this stretch is heat set and is therefore "permanent".

6 Claims, 2 Drawing Sheets

METHOD OF PRODUCING STRETCHABLE FABRICS

Figure 1:
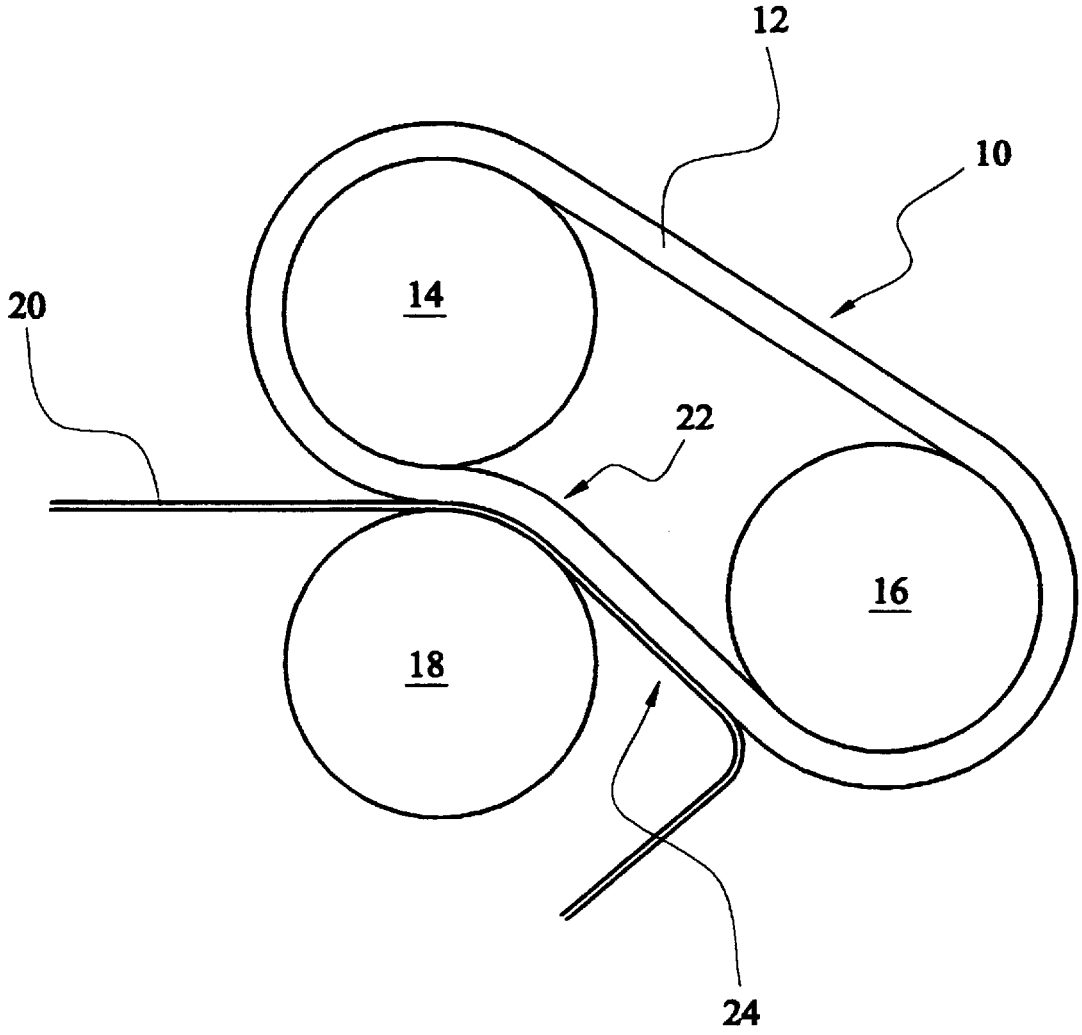

This invention relates to a process for treating fabric and to the fabric produced, particularly but not exclusively for application in clothing manufacture, which enables a certain degree and type of stretch to be imparted to, for example, an lining fabric.

In our European patent publication EP-B-0705356 we disclose a method of treating a woven fabric characterised in the combination of two stages—a first stage which includes applying heat and pressure to the fabric in such a manner that the yarn strands substantially across the width of the fabric are forced closer together thus imparting generally semi-permanent "ease" or "stretch" into the fabric, and a subsequent, second stage which includes affixing to the fabric treated according to the first stage of the method a selected lining and/or lining combination having inherent stretch whereby the semi-permanent "ease" or "stretch" imparted to the fabric during the first stage is made substantially permanent during the second stage.

The method of the above invention is preferably carried out by the machine as described therein which comprises means for applying heat and pressure to a woven fabric, and transport means for effecting relative movement between the heat and pressure application means and the fabric whereby passage of the fabric through the apparatus results in the yarn strands substantially across the width of the fabric being forced closer together thus imparting semi-permanent stretch into the fabric. This process may be described as "compressive shrinking" for the purposes of simplicity in the present description. When applied to a non-synthetic woven fabric, compressive shrinking produces stretch but this is not permanent in the sense that it is gradually lost or, if a subsequent heat or steam treatment is applied, will be lost completely at once. Thus, in the process of our above-mentioned European patent publication, the second stage was used to fix, or render "permanent", the stretch characteristics. Compressive shrinking is not normally used with synthetic, thermoplastic, fibres since these can be made stretchy by other known means, e.g. crimping the fibres.

There are a variety of stretch fabrics on the market which do not incorporate elastomers such as Lycra. These are sometimes described as 'mechanical stretch' materials, normally being of a synthetic material such as polyester. Stretch is achieved by mechanical means such as crimping the fibres and/or utilising the natural thermal shrinkage of the fibre during heat setting. The stretch in the width direction (normally the weft direction) may produced conventionally, but owing to processing constraints, it is not normally as easy to produce as much stretch in the length (or warp) direction.

The present invention seeks to provide a method of producing a synthetic fabric with linear or warp stretch properties which can additionally, if desired, be in combination with known techniques for achieving stretch across the width or weft.

According to the present invention there is provided a method of treating a woven fabric of thermoplastic synthetic fibres to produce a two-way stretchable fabric which comprises providing a fabric having stretch characteristics in the width direction, applying heat and pressure to the fabric in such a manner that the yam strands substantially across the width of the fabric are forced closer together thus imparting stretch into the fabric in the length direction.

The fabric material is a synthetic material which is thermoplastic and can be heat set, such as a polyester or polyamide textile material.

As mentioned above, stretch in the width direction (normally the weft direction) may produced conventionally, but owing to processing constraints, it is not normally as easy to produce as much stretch in the length (or warp) direction. By subjecting such a fabric to compressive shrinkage, the stretch in the warp direction is increased. Moreover, owing to the thermoplastic nature of the yarns, this stretch is heat set and is therefore 'permanent'. Such fabrics are ideal lining fabrics, particularly for lining garments which themselves have stretch characteristics, e.g. produced with Lycra or equivalent yarns. Skirts, especially, produced with bi-stretch or warp stretch fabrics need to utilise linings with similar characteristics. The invention is capable of producing such linings at a competitive cost in comparison to Elasthane or Lycra based linings. In addition, jacquard and other plain or printed ribboning, tape or labelling can benefit from the process of the invention. As well as woven fabrics, synthetic non-woven or knitted fabrics can be given extra stretch in accordance with the invention.

Moreover, it has been found that the compressive shrinking process imparts a sheen to one of the fabric surfaces, which is an additional advantage of the process when used for lining fabrics. The sheen provides the fabric with a 'kind' feel when next to the skin of the wearer.

The material used may be a fine woven polyamide or polyester fabric, preferably the latter and may already be an lining fabric. Treating it in accordance with the invention improves its stretch characteristics in the warp direction.

One passage through the machine will usually be sufficient to produce the finished product. As before, the fabric may be treated in full width form or in narrow width. It has been found that, at the temperature normally used in the compressive shrinking process the lining fabric, a thermoplastic synthetic material, typically a polyester fabric, is heat set so that the extra elasticity imparted to it by the compressive shrinking process is rendered "permanent". Many synthetic materials need to be processed at relatively high temperatures, e.g. 180–200° C. and we have found that the material used in our above mentioned compressive shrinking machine needs to be modified. The sleeve used is normally made from rubber, but this becomes degraded and hard at these temperatures. It is preferred to use a sleeve compound such as EPDM is order to overcome this.

While the fabric of the invention is primarily useful for linings, it is not so-limited. Other uses will become apparent to those skilled in the art.

The invention further extends to the fabric produced in accordance with the method of the invention.

Figure 2:
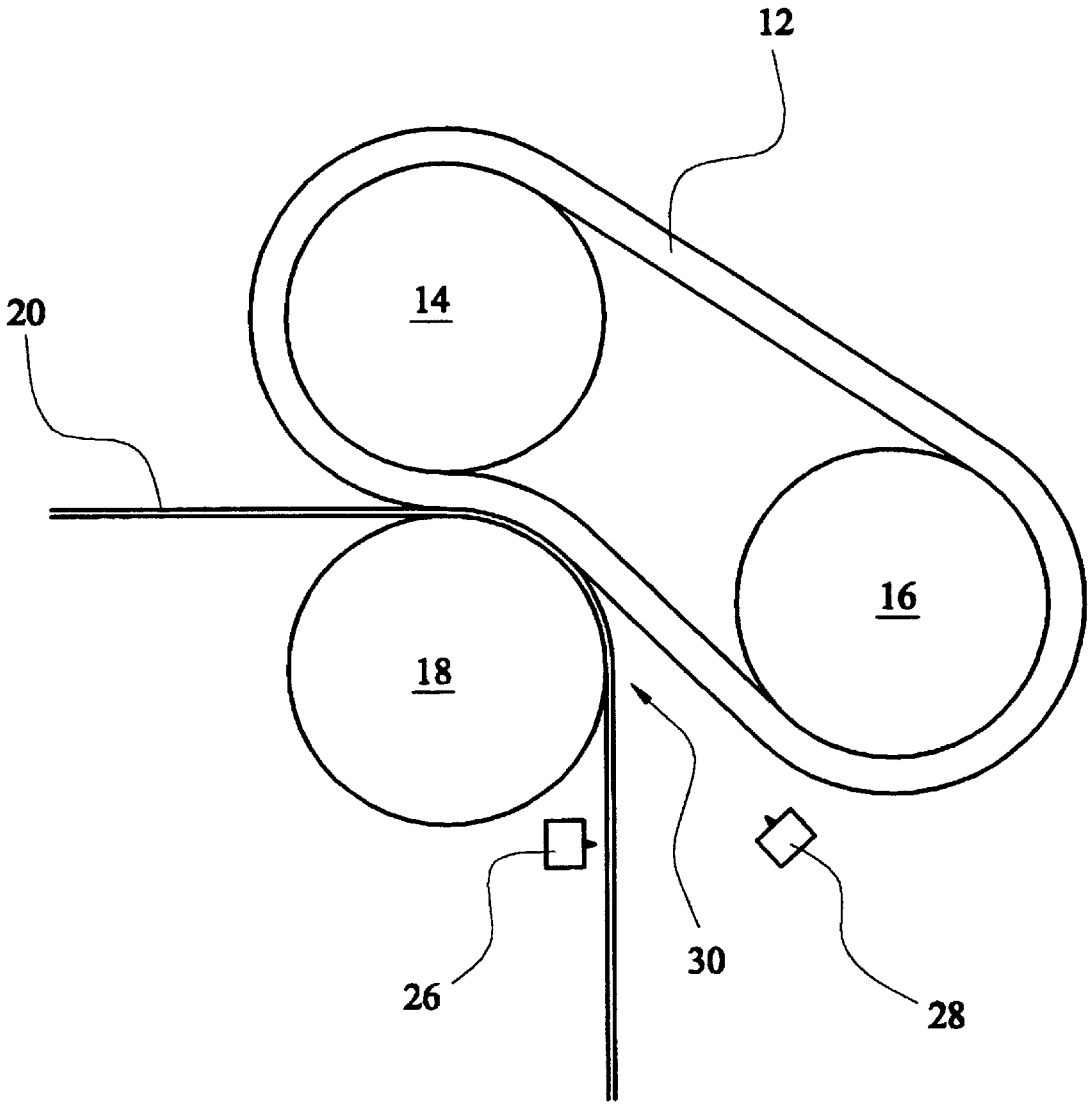

The invention will be described further, by way of example, with reference to the accompanying drawings, in which:

FIG. 1 is a diagrammatic side view of the machine of our European patent publication EP-B-0705356 proceesing material; and FIG. 2 is a similar view to FIG. 1 of a modified machine.

Referring to the drawings, and firstly FIG. 1, in essence the compressive shrinking machine generally designated 10 comprises a rubber sleeve 12 running on two rollers 14,16 driven by a heated roller 18.

Fabric 20 is fed into the nip between the roller 18 and the sleeve 12. The positioning of the roller 18 causes the path of the sleeve to change from convex to concave in the area 22 this is where the fabric 20 is compressed.

In conventional compressive shrinking equipment the fabric is pulled away from the equivalent of the zone 22. However, because the fibres are still hot and malleable, the tension causes any shrinking effect to be reduced or lost completely as the fibres have not yet set. The above mentioned machine allows the fabric to fall away (under no tension) and the shrinkage is retained. The problem with many synthetic fabrics, particularly polyester, is that static electricity is generated which causes the fabric to stick to the sleeve along zone 24 until 'dragged' off, destroying or reducing the stretch effect for the above reason.

Turning now to FIG. 2, in accordance with the present invention two grounded anti-static bars 26,28 are positioned to remove static from the system allowing the fabric 24 to fall away from the roller 18 at 30, preserving the stretch imparted in the nip.

What is claimed is:

1. A method of treating woven fabric strands of thermoplastic synthetic fibres to produce a two-way stretchable fabric, said method comprising:

providing a fabric (20) having stretch characteristics in the width direction, applying heat and pressure to the fabric by passing the fabric into a nip between a heated roller (18) and a sleeve (12) to force the strands across the width of the fabric closer together thus imparting stretch into the fabric in the length direction, locating the sleeve (12) above the fabric, supporting the fabric downstream of the sleeve (12), locating anti static bars (26, 28) downstream of the nip between the roller (14) and the sleeve (12) to remove static and allowing the fabric to fall away from the sleeve (12).

2. A method as claimed in claim 1 wherein the fabric (20) is a synthetic material which can be heat set.

3. A method as claimed in claim 2 wherein the fabric (20) is made from one of a polyester and a polyamide textile material.

4. A method as claimed in claim 1 in which the fabric (20) is a lining fabric.

5. A method as claimed in claim 1 further defined as introducing a processing temperature in the range 80–200° C.

6. A method as claimed in claim 5 further defined as providing the sleeve (12) of EPDM (ethylene-propylene-diene-rubber).

* * * * *